US008567415B2

(12) United States Patent
Morgandi et al.

(10) Patent No.: US 8,567,415 B2
(45) Date of Patent: Oct. 29, 2013

(54) HAIR STYLING APPARATUS

(75) Inventors: Arturo Morgandi, Azzano San Paolo (IT); Alberto Aguti, Azzano San Paolo (IT); Giorgio Caccia, Azzano San Paolo (IT); Renato Rodari, Azzano San Paolo (IT)

(73) Assignee: Tenacta Group S.p.A., Azzano San Paolo (IT)

( * ) Notice: Subject to any disclaimer, the term of this patent is extended or adjusted under 35 U.S.C. 154(b) by 146 days.

(21) Appl. No.: 13/057,475

(22) PCT Filed: Aug. 4, 2008

(86) PCT No.: PCT/IT2008/000534

§ 371 (c)(1),
(2), (4) Date: Apr. 29, 2011

(87) PCT Pub. No.: WO2010/016072

PCT Pub. Date: Feb. 11, 2010

(65) Prior Publication Data

US 2011/0253164 A1 Oct. 20, 2011

(51) Int. Cl.
*A45D 1/04* (2006.01)
*A45D 1/28* (2006.01)

(52) U.S. Cl.
USPC ..... 132/224; 132/269; 132/271; 219/225

(58) Field of Classification Search
USPC ..... 132/223, 224, 269, 271, 210, 211; 219/222–226, 492, 494, 497, 501, 505, 219/520, 521, 524, 533
See application file for complete search history.

(56) References Cited

U.S. PATENT DOCUMENTS

| | | | | | |
|---|---|---|---|---|---|
| 1,472,561 | A | * | 10/1923 | Haberkamp | 132/269 |
| 3,157,184 | A | * | 11/1964 | Lee et al. | 132/232 |
| 4,004,596 | A | * | 1/1977 | Hyland | 132/232 |
| 4,602,143 | A | * | 7/1986 | Mack et al. | 219/225 |
| 4,673,798 | A | * | 6/1987 | Contri et al. | 219/225 |
| 4,877,042 | A | * | 10/1989 | Downey | 132/212 |
| 4,953,574 | A | | 9/1990 | Tsuji et al. | |
| 5,345,055 | A | * | 9/1994 | Leung | 219/225 |
| 5,354,967 | A | * | 10/1994 | Barzilai et al. | 219/225 |
| 5,803,322 | A | * | 9/1998 | Boone et al. | 223/101 |

(Continued)

FOREIGN PATENT DOCUMENTS

| | | | |
|---|---|---|---|
| EP | 1623648 | A1 | 2/2006 |
| GB | 2432310 | A * | 5/2007 |

(Continued)

OTHER PUBLICATIONS

Japanese Office Action dated Jun. 5, 2012.

*Primary Examiner* — Todd Manahan
*Assistant Examiner* — Tatiana Nobrega
(74) *Attorney, Agent, or Firm* — Husch Blackwell LLP

(57) ABSTRACT

Hair styling apparatus including a first arm comprising a first heatable element, a second arm comprising a second heatable element, said second arm being connected to said first arm in such a way to allow the opening and closure of the apparatus by respectively moving said arms away and close one to each other; temperature regulators, associated to said heatable elements, comprising a heat source and a temperature sensor for regulating the temperature of said heatable elements; characterised in that it also comprises compensators, operatively connected to said temperature regulators, for compensating temperature drops to which said heatable elements are subjected when styling a hair lock.

10 Claims, 2 Drawing Sheets

(56) References Cited

U.S. PATENT DOCUMENTS

| | | | | |
|---|---|---|---|---|
| 6,026,821 | A * | 2/2000 | Last | 132/200 |
| 6,094,747 | A * | 8/2000 | Malick | 2/159 |
| 6,173,718 | B1 * | 1/2001 | Okumoto et al. | 132/224 |
| 7,123,823 | B2 * | 10/2006 | Ceva | 392/385 |
| RE41,321 | E * | 5/2010 | Okumoto et al. | 132/224 |
| 8,071,915 | B2 * | 12/2011 | Mukai | 219/225 |
| 2006/0124625 | A1 * | 6/2006 | Keig et al. | 219/222 |
| 2006/0191888 | A1 * | 8/2006 | Carlucci | 219/225 |
| 2006/0196523 | A1 * | 9/2006 | Choi | 132/224 |
| 2008/0007273 | A1 * | 1/2008 | Sherman et al. | 324/640 |
| 2009/0044823 | A1 * | 2/2009 | Overend et al. | 132/211 |
| 2009/0056736 | A1 * | 3/2009 | Suh | 132/217 |
| 2010/0154817 | A1 * | 6/2010 | Lee | 132/224 |
| 2010/0269848 | A1 * | 10/2010 | Morgandi et al. | 132/269 |

FOREIGN PATENT DOCUMENTS

| | | | | |
|---|---|---|---|---|
| GB | 2439523 | A * | 1/2008 | A45D 1/04 |
| JP | 4-72526 | B2 | 11/1992 | |
| JP | 2008-054982 | A | 3/2008 | |
| WO | 2006023802 | A2 | 3/2006 | |

* cited by examiner

HAIR STYLING APPARATUS

CROSS REFERENCE TO RELATED APPLICATIONS

This application is a U.S. National Phase Application of International Application No. PCT/IT2008/000534 filed on Aug. 4, 2008. The disclosure of International Application PCT/IT2008/000534 is incorporated herein by reference.

DESCRIPTION

The present invention refers to a hair styling apparatus; in particular, the apparatus of the invention finds a preferred application, though not exclusive, in a hair iron comprising two arms, heatable elements arranged on said arms and regulators adapted to regulate the temperature of said heatable elements.

Nowadays, both in professional salons and at home, there is an ever-growing use of hair styling apparatus, such as for example irons for hair ironing, straightening or curling.

Generally, hair irons are made up of a first and a second arm, connected one to each other by means of a hinge which allows the opening and closure of said arms, and by two heatable elements, one for each of said arms.

Generally, said heatable elements are controlled by an electronic system which adjusts the heatable elements to the desired temperature through a heat source, an electronic switch and a temperature sensor.

Examples of said hair styling apparatus are described, for example, in the patent application EP 1.623.648 and in the international patent application published as WO 2006-23802.

When subjecting a hair lock to a styling operation, the arms are opened in a way to be able to fit the hair lock between the two arms in contact with said heatable elements; subsequently, the arms are closed in order to hold the hair lock therebetween and start the styling operation. In such a position, the hair lock is subjected to the heat emitted by said heatable elements, for the time required for styling, before being released by the arms opening. At the end of said hair lock styling operation, the same hair lock may be subjected to a further styling operation, to obtain a better aesthetic effect, or a new hair lock can be subjected to one or more styling operations.

The Applicant has observed that by using the known in the art devices, the hair lock styling quality is not constant during the hair lock styling operation. In particular, the Applicant has observed that the quality tends to gradually deteriorate during the hair lock styling operation.

Consequently, due to the fact that generally such hair styling apparatus are used from the top to the bottom, the styling quality of the ends of hair lock—the last part of the hair lock to be styled—is generally unsatisfactory.

The Applicant has therefore tackled the technical problem of providing an apparatus capable of improving the hair locks styling quality.

In particular, the Applicant tackled the technical problem of providing an apparatus capable of obtaining a good styling quality for the entire length of a hair lock.

The Applicant realised that this could be obtained by means of a hair styling apparatus comprising:

a first arm comprising a first heatable element;

a second arm comprising a second heatable element, said second arm being connected to said first arm in such a way to allow the opening and closure of the apparatus by moving said arms respectively away from and close one to each other;

temperature regulators, associated to said heatable elements, comprising a heat source and a temperature sensor for regulating the temperature of said heatable elements;

characterised in that it also comprises compensators, operatively connected to said temperature regulators, for compensating temperature drops said heatable elements are subjected to during a hair lock styling.

In fact, the Applicant has noticed that, in order to optimise the hair lock styling, it is generally important that the temperature of the heatable elements remains basically constant (or at least within a given range of values) for the entire hair lock styling operation. This, for example, is particularly important for styling in a substantially uniform way the entire length of a hair lock, ends included, and for reducing the waiting times between two subsequent styling operations.

However, the Applicant has realised that, during a hair lock styling operation, the temperature of the heatable elements of the arms of the apparatus is subjected to a temperature drop caused by the contact of the heatable elements with the hair lock. In fact, upon contact with the hair lock, which has an ambient temperature, the heatable elements transfer heat to the hair lock and, consequently, cool. Such cooling gradually increases as the apparatus moves along the hair lock itself in that the apparatus continuously comes in contact with new portions of the hair lock yet to be modelled, and thus cold (ambient temperature). Consequently, upon coming in contact with the end of the hair lock, which is the hardest part to be styled, the heatable elements might have been subjected to a temperature drop not allowing an efficient hair lock styling any more.

Furthermore, the Applicant has noticed that the temperature drop said heatable elements are subjected to during a hair lock styling is detected by the temperature sensor with a substantial delay. The Applicant has noticed that this is due to the fact that, typically, for simplicity, the temperature sensor is not in direct contact with the heatable elements but it is fitted inside the two arms, in proximity to the heat source which cools with a substantial delay with respect to the heatable elements. Therefore, when the temperature sensor detects the temperature drop of the heat source and the temperature regulators intervene, the temperature of the heatable elements has already dropped and a substantial period of time is required to restore it. Once a lock styling is finished, this leads to requiring the user to wait for a given period of time before the temperature regulation restores the temperature of the heatable elements to the working temperature set by the user.

The apparatus of the invention, comprising compensators for compensating temperature drops said heatable elements are subjected to during a hair lock styling, allows the temperature of the heatable elements to be constantly maintained within a determined ideal temperature range, thus optimising the hair styling quality and reducing the waiting times between two subsequent styling operations.

In the present description and claims, the term "compensation" is used to indicate a reduction of temperature drops the heatable elements are subjected to during a hair lock styling.

Examples of hair styling operations are, for example, hair ironing or curling operations. Preferably, said apparatus is an electric iron for hair ironing.

Said first and said second heatable element are preferably arranged on the respective internal surfaces of said arms, in such a way to be in contact one with each other when said arms are in the same state of closed position.

Preferably, said heat source comprises a first heating element, adapted to heat said first heatable element, and a second heating element, adapted to heat said second heatable element.

Preferably, each of said heating elements is arranged in a space obtained inside the surface onto which the corresponding heating element is arranged.

Typically, the temperature sensor is arranged in proximity to one of the two heating elements.

Advantageously, the regulators are adapted to regulate the temperature of said heatable elements according to a first working temperature.

Typically, they are adapted to regulate the temperature of said heatable elements by activating/deactivating the heating elements according to the temperature detected by said temperature sensor, in such a way to maintain the temperature of said heatable elements close to the first working temperature.

Advantageously, the first working temperature can be selected by the user, within a predetermined temperature range, by a special user interface of the apparatus.

Advantageously, the compensators are adapted to control said temperature regulators in such a way to regulate the temperature of said heatable elements according to a second working temperature, higher than the first working temperature, during a hair lock styling.

According to a preferred embodiment, the compensators comprise a detection device for detecting the open/closed state of said arms and are adapted to control said temperature regulators in such a way to regulate the temperature of said heatable elements according to the second working temperature when said detection device detects a closed state of the arms.

Preferably, the regulators are adapted to regulate the temperature of said heatable elements according to the second working temperature up to the occurrence of one of the two following conditions: the end of a predetermined period of time $\Delta t$ or the detection of an open state of the two arms of the apparatus by said detection device.

Advantageously, upon the occurrence of one of the two conditions, the regulators are adapted to start again to regulate the temperature of said heatable elements according to the first working temperature.

Advantageously, the regulators are adapted to start regulating the temperature of said heatable elements according to the second working temperature with a preset delay with respect to the detection moment of the closed state of the arms by the detection device. This allows to avoid activating the temperature regulation of the heatable elements according to a second working temperature when the two arms are closed by the user only for a very short period of time, not intended for a hair lock styling.

In a second aspect, the present invention also regards a method for regulating the temperature of two heatable elements of two arms of a hair styling apparatus, the two arms being connected in such a way to allow the opening and closure of the apparatus by respectively moving the arms away and close one to each other, said method comprising the steps of: a) regulating the temperature of said heatable elements according to a first working temperature, characterised in that it also comprises the step of b) compensating temperature drops said heatable elements are subjected to during a hair lock styling.

Advantageously, step b) is performed by regulating the temperature of said heatable elements according to a second working temperature, higher than the first working temperature, during a hair lock styling.

Advantageously, step b) comprises the detection of an open/closed state of said arms and the regulation of the temperature of said heatable elements according to the second working temperature upon detection of the closed state of the arms.

Preferably, in step b) the regulation of the temperature of said heatable elements according to the second working temperature is performed up to the occurrence of one of the two following conditions: the end of a predetermined period of time $\Delta T$ or the detection of an open state of said arms.

Advantageously, upon the occurrence of one of the two conditions, the regulation of the temperature of said heatable elements starts again according to the first working temperature.

Further characteristics and advantages of the apparatus of the present invention shall be clearer from the following detailed description of some of its preferred embodiments, strictly provided for exemplifying and non-limiting purposes with reference to the attached drawings. In such drawings, FIG. 1 is a perspective view of a hair styling apparatus according to the invention;

Figure 1:
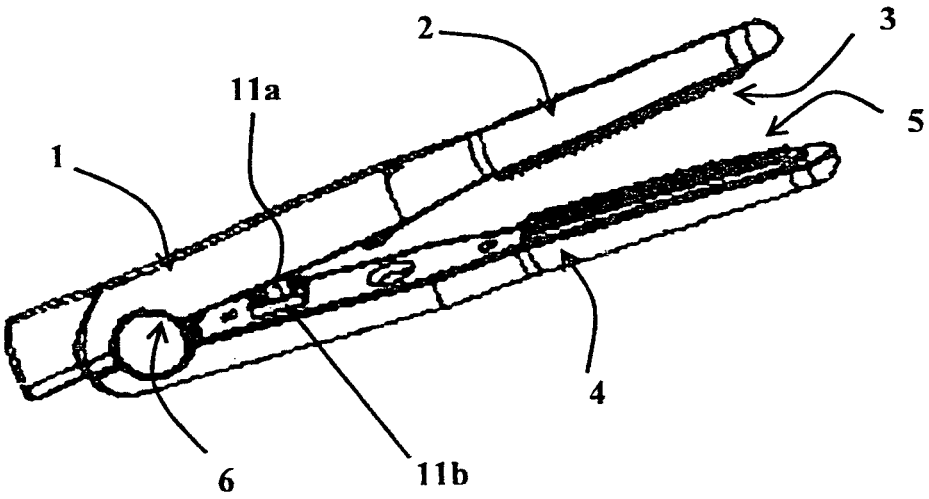

Referring to FIG. 1, indicated with 1 is a hair styling apparatus (in the example an electric iron for hair straightening) according to the invention. The apparatus 1 comprises two arms 2, 4 (shown in an open position) connected by a hinge 6. The two arms 2, 4 are respectively associated to two heatable elements 3, 5.

The apparatus 1 also comprises regulators, for regulating the temperature of said heatable elements 3, 5, which comprise an electronic card, a heat source and a temperature sensor (not shown in FIG. 1).

Figure 2:
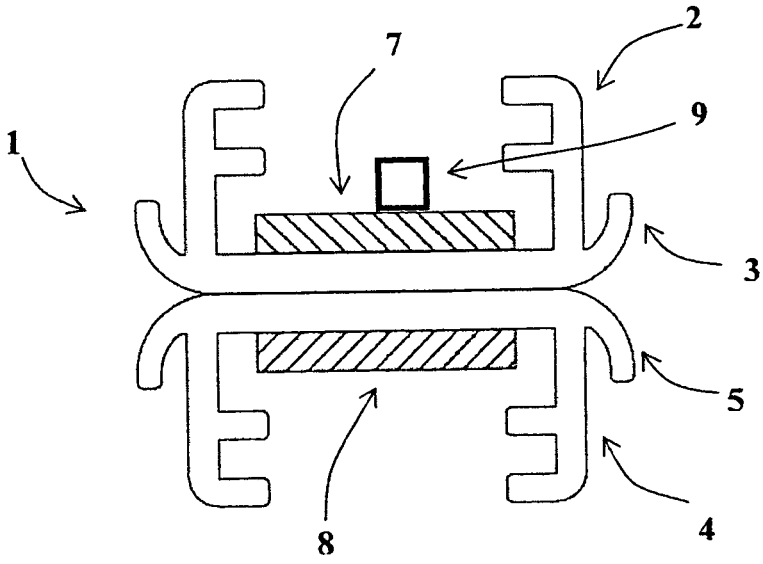
FIG. 2 is a section of the iron of FIG. 1 shown with the arms closed.

In the embodiment of FIG. 2—wherein the apparatus is shown with the arms 2, 4 closed—the heat source comprises two heating elements 7, 8 (for example two electric resistors) respectively arranged inside the arms 2, 4. Furthermore, the temperature sensor 9 is arranged at the heating elements 7.

The temperature sensor 9 can be for example a sensor with a negative temperature coefficient (NTC) positioned at direct contact with the heating element 7 or positioned close thereto. Alternatively, the temperature sensor 9 can be a device adapted to detect the temperature of the heating element 7 by measuring its electrical impedance (which varies according to the temperature).

The regulators are adapted to regulate the temperature of the heatable elements 3, 5 by activating/deactivating the heating elements 7, 8 depending on the temperature detected by the temperature sensor 9, in such a way to maintain the temperature of the heatable elements 3, 5 close to a first working temperature T1 (for example 230° C.) of the apparatus 1.

The first working temperature T1 is advantageously selected by the user, through a special user interface (not shown), within a predetermined range of values. For example, the range of values can be comprised between 120° C. and 250° C. In fact, below such minimum temperature, the hair styling operation might be scarcely efficient, while above such maximum temperatures the hair is exposed to damage risk. Preferably, the range of values is comprised between 140 and 230° C.

The apparatus 1 also comprises compensators, operatively connected to said temperature regulators, for compensating temperature drops said heatable means 3, 5 are subjected to during the hair lock styling operation.

According to a preferred embodiment, the compensators comprise a detection device 11 for detecting an open/closed state of the arms 2, 4 and are adapted to control said temperature regulators in such a way to regulate the temperature of said heatable elements 3, 5 according to a second working temperature T2, higher than the first working temperature T1, when said detection device 11 detects a closed state of the arms 2, 4.

Said detection device 11 can be, for example, a microswitch, a magnetic sensor, such as for example a "reed", or a light sensor, which changes state or position (open/closed) according to a change of state of the arms 2, 4 (open/closed). Preferably, said detection device 11 is arranged onto the internal surfaces of the arms 2, 4; more preferably, said detection device 11 comprises a first part 11*a*, arranged onto the internal surface of the arm 2, to generate, for example, a magnetic field or to obscure the environment light, and a second part 11*b*, arranged onto the internal surface of the arm 4, to detect the presence/absence of the magnetic field or the presence/absence of the environment light.

According to an embodiment, the compensators are adapted to determine the second working temperature value (T2) according to a preset temperature increase ΔT with respect to the first working temperature value (T1) (that is according to the relation T2=T1+ΔT). For example, said temperature increase ΔT can be comprised between 10° C. and 50° C.

Such temperature increase ΔT shall advantageously be determined (for example by the apparatus manufacturer) in such a way to obtain a good compromise between: obtaining a good compensation of the temperature drop the heatable elements 3, 5 are subjected to during a hair lock styling and avoiding that the temperature of the heatable elements exceeds the first working temperature value or a preset maximum temperature during the hair lock styling. Furthermore, the temperature increase ΔT shall be determined taking into account various parameters such as, for example, the first working temperature value, the power of the apparatus, the temperature drop the heating elements of the apparatus are subjected to during the hair lock styling and the reaction time of the temperature sensor of the apparatus.

When the first working temperature can be selected by the user within a predetermined range of values, the temperature increase ΔT can be fixed, regardless of the value selected by the user for the first working temperature, or vary depending on the value selected by the user. In the latter case, for example, the temperature increase ΔT can be a preset percentage of the first working temperature value selected by the user (that is, T2=T1+% T1). For example, such percentage can be comprised between 5% and 30%, more preferably between 5% and 25%.

The regulators are adapted to regulate the heatable elements 3, 5 temperature according to the second working temperature until a predetermined period of time ΔT passes (for example about 5-30 seconds) or the detection device 11 detects an open state of the arms 2, 4.

Said predetermined period of time Δt shall be advantageously predetermined (for example by the apparatus manufacturer) in such a way to obtain the suitable compromise between: obtaining a good compensation of the temperature drop the heatable elements 3, 5 are subjected to during the hair lock styling and avoiding that the heatable elements temperature exceeds the first working temperature value or a preset maximum temperature during the hair lock styling.

Furthermore, preferably, the regulation of the temperature of said heatable elements 3, 5 according to the second working temperature is implemented with a preset delay D (for example, from 0.1 seconds to 1 second) with respect to the detection moment of the closed state of the arms 2, 4 by the detection device 11.

The Applicant has carried out some tests to verify the operation of the invention apparatus with respect to a known reference apparatus, free of compensators for compensating possible temperature drops the heatable elements are subjected to during the hair lock styling.

REFERENCE EXAMPLE 1

A reference electric iron for hair straightening according to the prior art was used to iron 5 distinct hair locks according to the following procedure: two consecutive passes (pass A and pass B) on each hair lock for 20 seconds each; a pause of about 20 seconds between a lock and the other, with the two arms open; and a working temperature set at 230° C.

Figure 3:
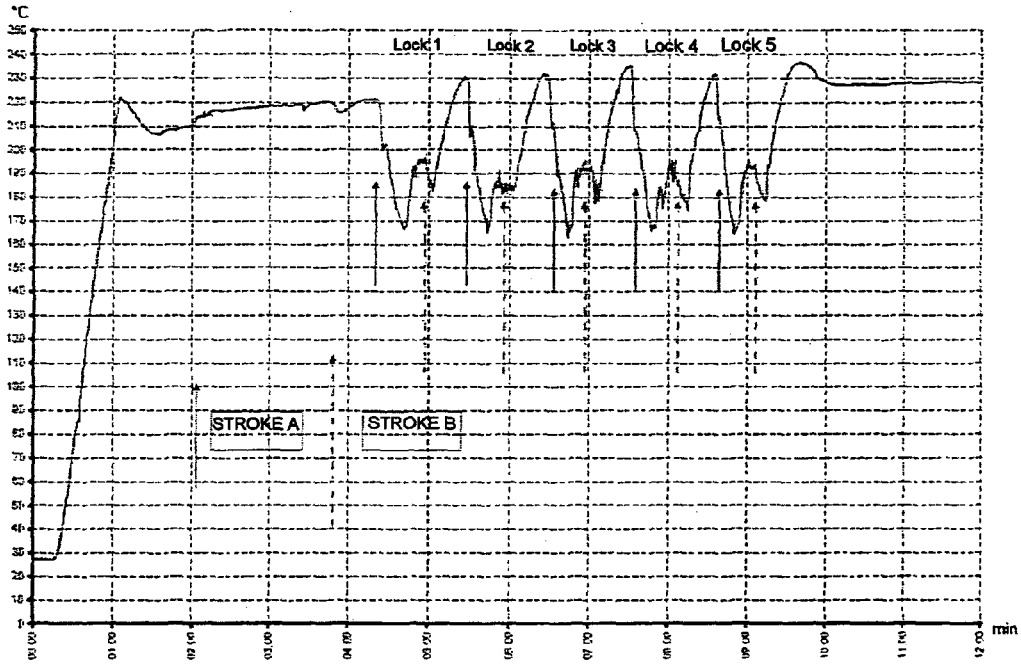
FIG. 3 shows a chart showing the temperature trend of the heatable elements when styling five hair locks in an electric hair iron known in the art.

FIG. 3 shows the temperature trend of the heatable elements obtained by means of the electric iron for hair straightening of the prior art, while Table 1 shows the temperature values of the heatable elements at the beginning and at the end of each styling operation, for each of the passes (A and B) of the 5 locks.

TABLE 1

| Reference iron | Initial temperature of the heatable elements | Final temperature of the heatable elements | Temperature variation |
|---|---|---|---|
| Lock 1 pass A | 221 | 167 | −54 |
| Lock 1 pass B | 197 | 183 | −14 |
| Lock 2 pass A | 230 | 165 | −65 |
| Lock 2 pass B | 192 | 183 | −9 |
| Lock 3 pass A | 231 | 163 | −68 |
| Lock 3 pass B | 195 | 177 | −18 |
| Lock 4 pass A | 235 | 165 | −70 |
| Lock 4 pass B | 196 | 174 | −22 |
| Lock 5 pass A | 232 | 165 | −67 |
| Lock 5 pass B | 196 | 178 | −18 |

As it is clear from the values of FIG. 3 and Table 1, considerable temperature drops (variations) were observed between the initial temperature and the final temperature of the heatable elements, in particular at the end of the first styling operation (pass 1A, 2A, 3A, 4A, 5A) of each of the locks 1-5. These temperature drops led to unsatisfactory styling quality, especially on the final part (the ends) of the locks.

EXAMPLE 2

A iron 1 for hair straightening according to the invention was used, having all the characteristics of the iron of example 1, with the difference that the iron of the invention also comprised the compensation means for compensating the temperature drops the heatable elements are subjected to during the hair lock styling. A light sensor as a detection device 11 was used in the experiment.

In the experiment, the second working temperature was set at T1+20° C. (230° C.+20° C.), the predetermined period of time ΔT was set at 20 seconds and the delay D with respect to the closure of the arms was set at 0.5 seconds.

The iron of the invention was then used for styling 5 hair locks, following the same procedure described in example 1.

Figure 4:
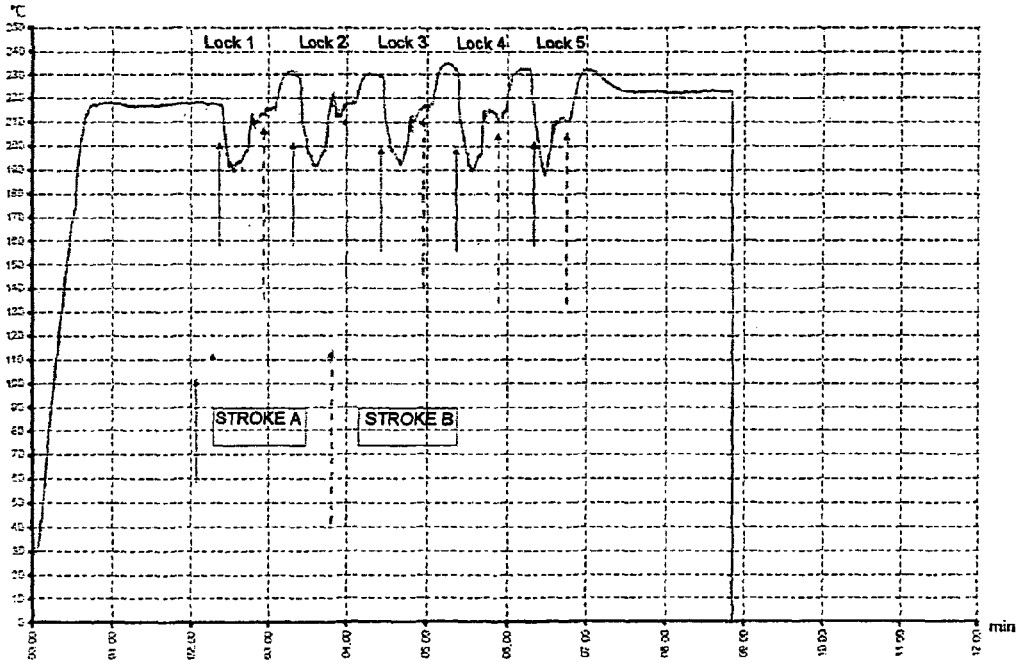
FIG. 4 shows a chart showing the temperature trend of the heatable elements when styling five hair locks in an apparatus according to the present invention.

FIG. 4 shows the temperature trend of the heatable elements 3, 5 obtained by means of the electric hair iron 1 according to the invention while Table 2 shows the temperature values of the heatable elements 3, 5 at the beginning and at the end of each styling operation, for each of the passes of the 5 locks.

TABLE 2

| Iron invention with algorithm | Initial temperature of the heatable elements | Final temperature of the heatable elements | Temperature variation |
|---|---|---|---|
| Lock 1 pass A | 218 | 189 | −29 |
| Lock 1 pass B | 213 | 215 | +2 |
| Lock 2 pass A | 231 | 192 | −39 |
| Lock 2 pass B | 222 | 218 | −4 |
| Lock 3 pass A | 230 | 192 | −38 |
| Lock 3 pass B | 213 | 216 | +3 |
| Lock 4 pass A | 235 | 190 | −45 |
| Lock 4 pass B | 215 | 214 | −1 |
| Lock 5 pass A | 232 | 188 | −44 |
| Lock 5 pass B | 209 | 211 | +2 |

As it is clear from the values of FIG. 4 and Table 2, by using the iron of the invention, a considerable reduction of temperature drops (variations) with respect to the reference iron of the prior art was observed.

Therefore, the apparatus according to the invention allows to improve the quality of the hair locks styling operations and to considerably reduce the waiting times between two subsequent styling operations.

The invention claimed is:

1. A hair styling apparatus comprising:

a first arm comprising a first heatable element;

a second arm comprising a second heatable element, said second arm being connected to said first arm in such a way as to allow opening and closing of the apparatus by respectively moving said arms between an open state away from one another and a closed state close to each other;

temperature regulators associated to said heatable elements comprising a heat source and a temperature sensor for regulating the temperature of said heatable elements;

compensators operatively connected to said temperature regulators adapted to compensate temperature changes which said heatable elements are subjected to when styling a hair lock;

wherein the compensators comprise a detection device for detecting an open state and a closed state of said arms and is adapted to control said temperature regulators in order to regulate the temperature of said heatable elements such that when the detection device detects the arms are in the open state the heatable elements operate at a first working temperature (T1) and when the detection device detects the arms are in the closed state the heatable elements operate at a second working temperature (T2) to styling a hair lock, where the second working temperature (T2) is higher than the first working temperature (T1);

wherein the temperature sensor detects the temperature of the heat source and based on the detected temperature the temperature regulators either activates or deactivates the heat source to maintain the temperature of the heatable elements at either the first working temperature (T1) or the second working temperature (T2) based on the position of the arms.

2. The apparatus according to claim 1, wherein the temperature regulators are adapted to regulate the temperature of said heatable elements according to the second working temperature T2 up to the occurrence of one of the following two conditions: the end of a predetermined period of time (Δt) or the detection of an open state of the two arms by said detection device.

3. The apparatus according to claim 2, wherein upon the occurrence of one of the two conditions the temperature regulators are adapted to start again regulating the temperature of said heatable elements according to the first working temperature T1.

4. The apparatus according to claim 1, wherein the temperature regulators are adapted to start regulating the temperature of said heatable elements according to the second working temperature T2 with a preset delay (D) with respect to a detection moment of the closed state of the arms by the detection device.

5. The apparatus according to claim 1, wherein said heat source comprises a first heating element, adapted to heat said first heatable element, and a second heating element, adapted to heat said second heatable element.

6. The apparatus according to claim 1, wherein said first working temperature T1 can be selected by the user within a predetermined range of values.

7. The apparatus according to claim 1, wherein the compensators are adapted to determine the second working temperature (T2) according to a preset temperature increase (ΔT) with respect to the first working temperature (T1).

8. A method for regulating the temperature of two heatable elements of two arms of a hair styling apparatus, the two arms being connected in such a way to allow the opening and closure of the apparatus by respectively moving the arms away and close one to each other; said method comprising the steps of:

a) regulating the temperature of said heatable elements according to a first working temperature T1 or a second working temperature (T2) with temperature regulators, where the second working temperature (T2) is higher than the first working temperature (T1), characterised in that it also comprises the steps of b) detecting an open state and a closed state of said arms by a detection device of compensators, c) adapting to control the temperature regulators in order to regulate the temperature of said heatable elements such that when the detection device detects the arms are in the open state the heatable elements operate at the first working temperature (T1) and when the detection device detects arms are in the closed state the heatable elements operate at the second working temperature (T2), d) compensating temperature changes from said first working temperature (T1) or from said second working temperature (T2), which said heatable elements are subjected to when styling a hair lock;

e) detecting the temperature of a heat source of the temperature regulators and based on the detected temperature the temperature regulators either activates or deactivates the heat source to maintain the temperature of the heatable elements at either the first working temperature (T1) or the second working temperature (T2) based on the position of the arms.

9. The method according to claim 8, wherein in step d) the temperature regulation of said heatable elements according to the second working temperature T2 is performed up to the occurrence of one the following two conditions: the end of a predetermined period of time (Δt) or the detection of an open state of said arms.

10. The method according to claim 9, wherein, upon the occurrence of one of the two conditions, the temperature regulation of said heatable elements starts again according to the first working temperature.

* * * * *

UNITED STATES PATENT AND TRADEMARK OFFICE

CERTIFICATE OF CORRECTION

PATENT NO. : 8,567,415 B2
APPLICATION NO. : 13/057475
DATED : October 29, 2013
INVENTOR(S) : Morgandi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 232 days.

Signed and Sealed this
Fifteenth Day of September, 2015

Michelle K. Lee

Michelle K. Lee
*Director of the United States Patent and Trademark Office*